US009105964B2

(12) United States Patent
Muri et al.

(10) Patent No.: US 9,105,964 B2
(45) Date of Patent: Aug. 11, 2015

(54) AIRBORNE SATELLITE COMMUNICATIONS SYSTEM

(75) Inventors: Mark E. Muri, Ramona, CA (US); Peter Alexander Carides, San Diego, CA (US); Simon H. Dickhoven, Santee, CA (US); Marc S. Janov, San Diego, CA (US); Barry R. Robbins, Carlsbad, CA (US)

(73) Assignee: AASKI TECHNOLOGY, INC., Ocean, NJ (US)

( * ) Notice: Subject to any disclaimer, the term of this patent is extended or adjusted under 35 U.S.C. 154(b) by 490 days.

(21) Appl. No.: 13/473,490

(22) Filed: May 16, 2012

(65) Prior Publication Data

US 2013/0307725 A1 Nov. 21, 2013

(51) Int. Cl.
*H01Q 1/12* (2006.01)
*H01Q 1/32* (2006.01)

(52) U.S. Cl.
CPC . *H01Q 1/125* (2013.01); *H01Q 1/32* (2013.01)

(58) Field of Classification Search
CPC ..... H01Q 1/125; H01Q 3/04; H01Q 3/08; H01Q 1/1257
USPC ..... 342/357.21, 357.4, 357.63, 359; 343/754, 757
See application file for complete search history.

(56) References Cited

U.S. PATENT DOCUMENTS

| | | | | |
|---|---|---|---|---|
| 5,447,497 | A | 9/1995 | Sogard et al. | |
| 5,999,131 | A | 12/1999 | Sullivan | |
| 6,593,875 | B2 | 7/2003 | Bergin et al. | |
| 6,677,890 | B2 | 1/2004 | Halsey et al. | |
| 6,724,340 | B1 | 4/2004 | Carlos et al. | |
| 6,917,880 | B2 | 7/2005 | Bergin et al. | |
| 2010/0188304 | A1 * | 7/2010 | Clymer et al. | 343/753 |

* cited by examiner

*Primary Examiner* — Dao Phan
(74) *Attorney, Agent, or Firm* — Nydegger & Associates

(57) ABSTRACT

A system is provided to establish and maintain a data path between a Local Area Network (LAN) that is mounted on a moving vehicle and a satellite. In combination, an antenna assembly, an Antenna Control Unit (ACU), an Inertial reference Unit (IRU), and a modem are mounted together on the moving vehicle, under the overall control of a services platform. Operationally, the IRU generates parametric values indicative of the spatial attitude and location of the moving vehicle. The ACU then uses the parametric values to aim the antenna in a direction toward the satellite. In this combination, the modem is connected with the antenna to transmit and receive data between the system and the satellite. Individually or collectively, operationally compatible components of the system (IRU, ACU, antenna and modem) can be appropriately substituted to thereby customize the system.

20 Claims, 1 Drawing Sheet

AIRBORNE SATELLITE COMMUNICATIONS SYSTEM

FIELD OF THE INVENTION

The present invention pertains generally to satellite communications systems. More particularly, the present invention pertains to satellite communications systems wherein a Local Area Network (LAN) is mounted on a moving vehicle. The present invention is particularly, but not exclusively, useful in a satellite communications system wherein the combination of components for communication and antenna control can be customized for operational compatibility, to thereby establish and maintain a data path between the moving vehicle and the satellite.

BACKGROUND OF THE INVENTION

Satellite communications systems rely on the ability of a LAN to establish and maintain a data path between the station and the satellite. Not surprisingly, this is no easy task. Moreover, the ability to operationally maintain the data path becomes increasingly complex when the LAN is mounted on a moving vehicle. Accordingly, the operational control of an antenna assembly that is suitable for use with the moving vehicle is a very important design consideration.

As a practical matter, there are many different types of moving vehicles (i.e. airborne, terrestrial and maritime), and they will each have their own respectively unique and different operational requirements. A consequence of these differences is that different types of antenna assemblies are typically required. Further, as implied above, each antenna assembly will necessarily have its own control requirements. On top of this, operational flexibility may require the ability to change the configuration of a particular LAN and/or its antenna assembly. More specifically, there are situations wherein it may be desirable to replace one antenna assembly with another type antenna assembly. In such a case, as well as in other cases wherein moving vehicles have unique but changed requirements, the ability to substitute one antenna assembly for another may be desirable. In the event, system component compatibility and interoperability must be established.

In light of the above, it is an object of the present invention to provide a customized satellite communications system with the capability of individually or collectively substituting operationally essential components, such as an antenna assembly, without compromising the system's operational compatibility. Still another object of the present invention is to provide a satellite communications system that can establish and maintain a data path between a satellite and a moving vehicle. Yet another object of the present invention is to provide a satellite communications system with a flexible methodology for changing operationally compatible components that is easy to perform in a cost effective manner.

SUMMARY OF THE INVENTION

In accordance with the present invention, a system is provided for use in connecting a LAN into a satellite communications network. Specifically, the system is provided to establish a central management interface between the electronic components that interchange operational data. In particular, this interchange of data is accomplished by the system to control the components that establish and maintain a data path between the LAN and a satellite. As envisioned for the present invention the system will be mounted on a moving vehicle that may either be airborne, terrestrial or maritime.

Components for the system of the present invention include a services platform, an antenna assembly, an Antenna Control Unit (ACU), an Inertial Reference Unit (IRU) and a modem. For communication purposes, the antenna assembly is connected to the modem, and the modem is connected with the services platform. In turn, the services platform is connected to the LAN. Thus, the LAN is connected in communication with the antenna assembly. On the other hand, for control purposes, the antenna assembly is connected with the ACU, and the ACU is connected via the services platform with the IRU. Thus, the antenna assembly is operationally controlled by the ACU to establish and maintain a communication data path between the LAN and a satellite.

For operational control of the antenna assembly, the IRU generates parametric values that are transferred by the services platform for input to the ACU. More specifically, these parametric values are indicative of both a spatial attitude of the moving vehicle (e.g. pitch, roll and yaw), and a location of the moving vehicle (e.g. position, altitude and velocity). Typically, the location information can be provided by a GPS capability. In the event of a GPS failure, however, the system of the present invention can revert to inertial sensing techniques for its location information.

In operation, under control from the services platform, the ACU converts input from the IRU into antenna orientation parameters. More specifically, based on inputs from the IRU, the antenna assembly is dynamically oriented by the ACU in response to movements of the vehicle. Thus, movements of the antenna assembly are controlled with appropriate elevation, azimuth and polarization inputs to establish a data path between the antenna and the satellite. At the same time, also under control from the services platform, system signals will be converted between Ku-band (used on the data path between the moving vehicle and the satellite) and L-band (between the LAN and the modem and between the modem and the antenna). Further, the services platform and modem encode/decode and assemble/disassemble data. The services platform will also direct data transmissions in the LAN.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
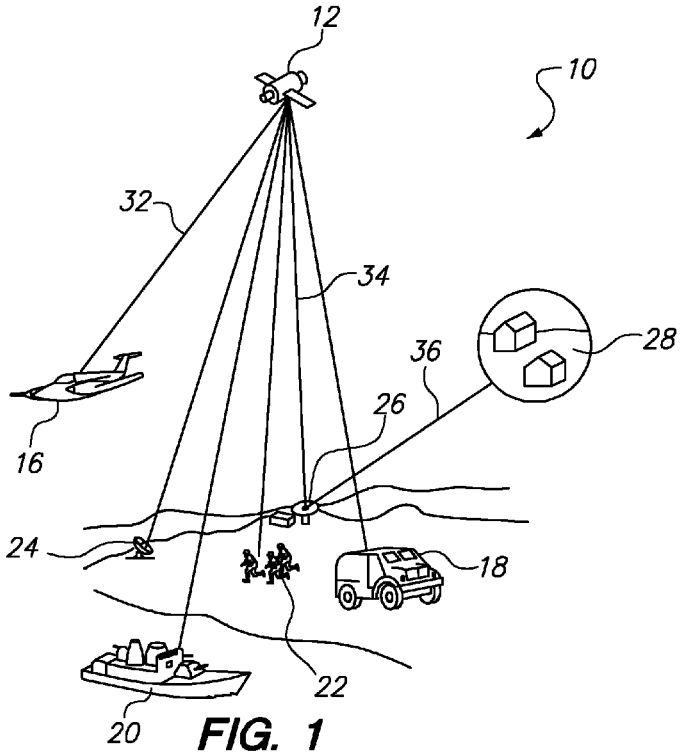
FIG. 1 depicts an operational environment for the present invention.

Referring initially to FIG. 1 an environment for implementing the present invention is shown and is generally designated 10. As shown, a satellite 12 is used to establish a communication link with a Local Area Network (LAN) 14 [see FIG. 2] which can be variously located on a moving vehicle in the environment 10. For instance, a LAN 14 can be carried on an airborne vehicle 16, a terrestrial vehicle 18 or a maritime vehicle 20. As envisioned for the present invention, the airborne vehicle 16 may be an airplane (as shown), or it may be a rocket, a balloon, a helicopter or a pilotless drone.

Further, the terrestrial vehicle 18 may be a truck (as shown), or it may be any other form of land transportation. Additionally, the maritime vehicle 20 may be a ship (as shown), or any other form of seaborne transportation. Also, a LAN 14 may be carried by personnel 22 or connected with a mobile base 24. In each case there will be a communication link between a respective LAN 14 and the satellite 12. There will also be extended communication between the satellite 12 and a ground-based central hub 26. From there, another communication link is established between the central hub 26 and a central facility 28. As envisioned for the present invention, overall control of the components that interconnect the LAN 14 with the satellite 12 is provided by a system 30 (see FIG. 2).

For purposes of this disclosure, consider the moving vehicle to be the airborne vehicle 16, and that it is in communication with the central facility 28. As shown in FIG. 1, this essentially requires three communication links. First, there is a data path 32 from the airborne (moving) vehicle 16 to the satellite 12. Next, there is a data path 34 from the satellite 12 to the hub 26. And finally, there will be a data path 36 from the hub 26 to the central facility 28. In this context, the data path 34 can be established in any of several ways known in the pertinent art, and the data path 36 can be established using known technology. Of specific interest for the present invention, however, is the data path 32.

Figure 2:
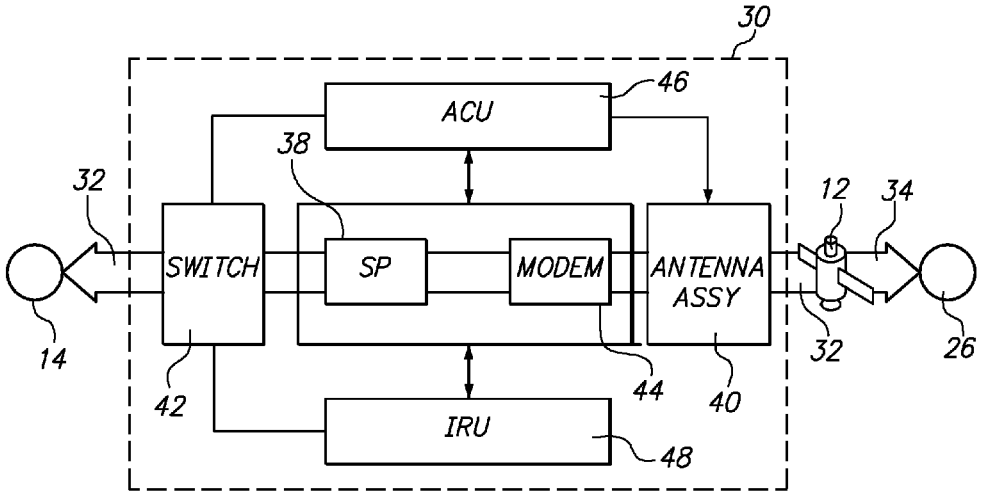
FIG. 2 is a schematic layout of the components that are used by the present invention to establish and maintain a data path between a moving vehicle and a satellite.

With reference to FIG. 2 it will be appreciated that the data path 32 is to be controlled and maintained by connections in the system 30 that are established and controlled by a services platform 38. In accordance with the present invention, the operational control provided by the system 30 is functionally two-fold. On the one hand, there is the orientation control of an antenna assembly 40. On the other, there is the communication control of a switch 42. Overall control of both is effectively provided by the services platform 38.

For the communication functions of the present invention, consider the data path 32 that extends between the satellite 12 and the LAN 14. Keep in mind, this will be a two-way communications data path 32 for both transmit and receive by the LAN 14. Between the satellite 12 and the system 30, the data that is carried on the data path 32 will be carried on Ku-band. Data that is received by the antenna assembly 40 will be passed to a system 30 where it is converted from Ku-band to L-band. In concert with the services platform 38, the modem 44 will then also be used to encode/decode and assemble/disassemble the packets of data that are being transmitted on the data path 32. Further, at the services platform 38, the communications data on data path 32 is sorted and routed through the switch 42 for further transmission to appropriate stations in the LAN 14.

For the orientation function of aiming the antenna assembly 40 toward the satellite 12, the system 30 of the present invention incorporates an Antenna Control Unit (ACU) 46 and an Inertial Reference Unit (IRU) 48. As shown, the ACU 46 is connected to the antenna assembly 40, and it is controlled by the services platform 38, for the purpose of moving the antenna assembly 40 to maintain the data path 32 between the system 30 and the satellite 12. As also shown, the IRU 48 is controlled by the services platform 38 to generate inputs of parametric values to the ACU 46 which are indicative of a spatial attitude of the vehicle 16, and its location. In particular, the parametric values for measuring the spatial attitude of the moving airborne vehicle 16 include measurements of pitch, roll and yaw. On the other hand, parametric values for identifying the location of the moving vehicle 16 include position, altitude and velocity. Preferably, the parametric values for the location of the moving vehicle 16 are obtained by selectively using GPS or inertial sensing techniques. Based on these inputs the antenna assembly 40 is dynamically oriented with elevation, azimuth and polarization inputs from the ACU 46.

While the particular Airborne Satellite Communications System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for use in a communications network to establish and maintain a data path between a moving vehicle and a satellite which comprises:

a Local Area Network (LAN) mounted on the moving vehicle;

an antenna assembly mounted on the moving vehicle for connecting the LAN in communication with the satellite via the data path, wherein the antenna assembly is selected from a plurality of different types of antenna assemblies;

a services platform supported on the moving vehicle for central management of data transfer in the system;

a modem connected with the services platform between the LAN and the antenna assembly to convert signals between Ku-band and L-band and to encode/decode and assemble/disassemble data for data transmissions in the LAN; and a control unit positioned on the moving vehicle and connected via the services platform with the selected antenna assembly to functionally maintain the data path by dynamically orienting the antenna assembly in response to movements of the vehicle, wherein the control unit is selectively configured for operational compatibility with the antenna assembly.

2. A system as recited in claim 1 wherein the control unit comprises:

an Antenna Control Unit (ACU) connected to the antenna assembly for moving the antenna assembly to maintain the data path;

an Inertial Reference Unit (IRU) connected to the ACU via the services platform for generating an input of parametric values to the ACU, wherein the parametric values are indicative of a spatial attitude of the vehicle and a location of the vehicle; and a modem connected between the LAN and the antenna assembly for providing data transfer capabilities on the data path.

3. A system as recited in claim 2 wherein the parametric values for the spatial attitude of the moving vehicle include measurements of pitch, roll and yaw.

4. A system as recited in claim 2 wherein the parametric values for the location of the moving vehicle include position, altitude and velocity.

5. A system as recited in claim 4 wherein the parametric values for the location of the moving vehicle are obtained by selectively using GPS and inertial sensing techniques.

6. A system as recited in claim 1 wherein the moving vehicle is selected from a group comprising an airborne vehicle, a terrestrial vehicle and a maritime vehicle.

7. A system as recited in claim 6 wherein the airborne vehicle is selected from a group comprising an aircraft, a rocket, a helicopter, an unmanned aerial vehicle and a balloon.

8. A system as recited in claim 1 wherein the antenna assembly is dynamically oriented with elevation, azimuth and polarization inputs from the control unit.

9. A method for customizing a system for use in a communications network to establish and maintain a data path between a moving vehicle and a satellite which comprises the steps of:

selecting an antenna assembly;

mounting the antenna assembly on the moving vehicle;

supporting a services platform on the moving vehicle for central management of data transfer in the system;

connecting an Antenna Control Unit (ACU) to the services platform and to the selected antenna assembly;

generating parametric values with an Inertial Reference Unit (IRU) for input from the IRU to the ACU via connections on the services platform, wherein the parametric values are indicative of a spatial attitude of the platform and a location of the vehicle;

orienting the antenna assembly with control inputs from the ACU in response to dynamic movements of the vehicle, to enable data transmissions along a data path, wherein the data path establishes communications between a Local Area Network (LAN) on the moving vehicle and the satellite; and incorporating a modem, wherein the modem is connected with the services platform between the LAN and the antenna assembly to convert signals between Ku-band and L-band and to encode/decode and assemble/disassemble data for data transmissions in the LAN.

10. A method as recited in claim 9 wherein the antenna assembly, the modem, the ACU, and the IRU are respectively selected for mutual operational capability in the system.

11. A method as recited in claim 9 wherein the ACU is selectively configured for operational compatibility with the antenna assembly.

12. A method as recited in claim 9 wherein the parametric values for the spatial attitude of the moving vehicle include measurements of pitch, roll and yaw.

13. A method as recited in claim 9 wherein the parametric values for the location of the moving vehicle include position, altitude and velocity.

14. A method as recited in claim 9 wherein the parametric values for the location of the moving vehicle are obtained using GPS techniques.

15. A method as recited in claim 9 wherein the antenna assembly is dynamically oriented with control inputs from the ACU, and wherein the control inputs include values for elevation, azimuth and polarization.

16. A customized system for use in a communications network to establish and maintain a data path between a moving vehicle and a satellite which comprises:

an antenna assembly;

an Antenna Control Unit (ACU) connected to the antenna assembly for moving the antenna assembly to maintain the data path, wherein the ACU is dedicated to the selected antenna assembly;

an Inertial Reference Unit (IRU) connected to the ACU for generating an input of parametric values to the ACU, wherein the parametric values are indicative of a spatial attitude of the vehicle and a location of the vehicle, and wherein the parametric values are input to the ACU to functionally maintain the data path by dynamically orienting the antenna assembly in response to movements of the vehicle; and a modem connected between the antenna assembly and a LAN to provide data transfer capabilities on the data path, and to convert signals between Ku-band and L-band and to encode/decode and assemble/disassemble data for data transmissions in the LAN.

17. A system as recited in claim 16 wherein the parametric values for the spatial attitude of the moving vehicle include measurements of pitch, roll and yaw.

18. A system as recited in claim 16 wherein the parametric values for the location of the moving vehicle include position, altitude and velocity.

19. A system as recited in claim 18 wherein the parametric values for the location of the moving vehicle are obtained by selectively using GPS and inertial sensing techniques.

20. A system as recited in claim 16 wherein the antenna assembly is dynamically oriented with elevation, azimuth and polarization inputs from the ACU.

* * * * *